US010443354B2

(12) United States Patent
Murphree et al.

(10) Patent No.: US 10,443,354 B2
(45) Date of Patent: Oct. 15, 2019

(54) SELF-PROPELLED DEVICE FOR USE IN A SUBTERRANEAN WELL

(71) Applicant: HALLIBURTON ENERGY SERVICES, INC., Houston, TX (US)

(72) Inventors: Zachary R. Murphree, Dallas, TX (US); Michael L. Fripp, Carrollton, TX (US); Thomas J. Frosell, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 351 days.

(21) Appl. No.: 14/759,304

(22) PCT Filed: Oct. 6, 2014

(86) PCT No.: PCT/US2014/059298
§ 371 (c)(1),
(2) Date: Jul. 6, 2015

(87) PCT Pub. No.: WO2016/057011
PCT Pub. Date: Apr. 14, 2016

(65) Prior Publication Data
US 2016/0251941 A1 Sep. 1, 2016

(51) Int. Cl.
*E21B 41/00* (2006.01)
*E21B 23/01* (2006.01)
(Continued)

(52) U.S. Cl.
CPC ..... *E21B 41/00* (2013.01); *E21B 23/01* (2013.01); *E21B 23/06* (2013.01); *E21B 33/128* (2013.01);
(Continued)

(58) Field of Classification Search
CPC .... E21B 34/14; E21B 2023/008; E21B 23/14; E21B 23/08
See application file for complete search history.

(56) References Cited

U.S. PATENT DOCUMENTS 4,676,310 A * 6/1987 Scherbatskoy ..... E21B 23/10 166/113
4,862,808 A 9/1989 Hedgcoxe et al.
(Continued)

FOREIGN PATENT DOCUMENTS

WO 9812418 A2 3/1998
WO 2005084833 A1 9/2005
(Continued)

OTHER PUBLICATIONS

International Search Report and Written Opinion dated Jun. 23, 2015 for IA PCT/US14/059298, 13 pages.
(Continued)

*Primary Examiner* — Kipp C Wallace
(74) *Attorney, Agent, or Firm* — Locke Lord LLP

(57) ABSTRACT

A well system can include a deployment apparatus including at least one propeller that propels the deployment apparatus through a wellbore. A deployment apparatus for use in a well can include a sealing device that sealingly engages a seal surface in the well, and at least one propeller that propels the deployment apparatus in the well. A deployment method can include disposing a deployment apparatus in a wellbore of a well, the deployment apparatus including at least one propeller, and the propeller propelling the deployment apparatus in the wellbore.

17 Claims, 4 Drawing Sheets

(51) Int. Cl.

| | |
|---|---|
| ***E21B 23/06*** | (2006.01) |
| ***E21B 33/128*** | (2006.01) |
| ***E21B 33/129*** | (2006.01) |
| *E21B 34/14* | (2006.01) |
| *E21B 23/00* | (2006.01) |
| *E21B 33/12* | (2006.01) |

(52) U.S. Cl.
CPC ..... *E21B 33/129* (2013.01); *E21B 33/12* (2013.01); *E21B 2023/008* (2013.01)

(56) References Cited

U.S. PATENT DOCUMENTS

| | | | | |
|---|---|---|---|---|
| 5,392,715 | A | 2/1995 | Pelrine | |
| 6,880,195 | B1 * | 4/2005 | Bahari | B08B 9/049 15/104.061 |
| 7,055,625 | B1 * | 6/2006 | Myrick | E21B 4/18 175/26 |
| 7,322,416 | B2 | 1/2008 | Burris, II et al. | |
| 9,546,544 | B2 * | 1/2017 | Al-Badran | E21B 47/00 |
| 2002/0050930 | A1 * | 5/2002 | Thomeer | E21B 23/00 340/853.3 |
| 2004/0055746 | A1 * | 3/2004 | Ross | B23K 3/0623 166/250.15 |
| 2006/0124310 | A1 | 6/2006 | Lopez De Cardenas et al. | |
| 2011/0168390 | A1 | 7/2011 | Fripp et al. | |
| 2011/0180274 | A1 | 7/2011 | Wang et al. | |
| 2012/0118582 | A1 | 5/2012 | Soni et al. | |
| 2013/0025852 | A1 * | 1/2013 | Edmonstone | E21B 23/10 166/250.01 |
| 2013/0319661 | A1 * | 12/2013 | Xiao | E21B 43/121 166/250.03 |
| 2015/0107855 | A1 | 4/2015 | Murphree et al. | |
| 2015/0218923 | A1 * | 8/2015 | Hallundbæk | E21B 33/1275 166/305.1 |

FOREIGN PATENT DOCUMENTS

| | | | |
|---|---|---|---|
| WO | 2015060826 | A1 | 4/2015 |
| WO | 2016/057011 | A1 | 4/2016 |

OTHER PUBLICATIONS

Jun. 23, 2015 International Search Report in PCT/US2014/059298, 5 pages.
Jun. 23, 2015 Written Opinion in PCT/US2014/059298, 8 pages.

* cited by examiner

SELF-PROPELLED DEVICE FOR USE IN A SUBTERRANEAN WELL

CROSS-REFERENCE TO RELATED APPLICATION

This application is a national stage under 35 USC 371 of International Application No. PCT/US14/59298, filed on 6 Oct. 2014. The entire disclosure of this prior application is incorporated herein by this reference.

TECHNICAL FIELD

This disclosure relates generally to equipment utilized and operations performed in conjunction with a subterranean well and, in one example described below, more particularly provides a self-propelled deployment device.

BACKGROUND

It is sometimes advantageous to be able to deploy an object or substance into a well. For example, a plug can be deployed to actuate a well tool, or to seal off a section of a wellbore or a casing or tubing string therein. Electrical, optical and other types of lines can be deployed into a well.

Therefore, it will be appreciated that advancements are continually needed in the art of deploying objects and substances into wells.

DETAILED DESCRIPTION

Figure 1:
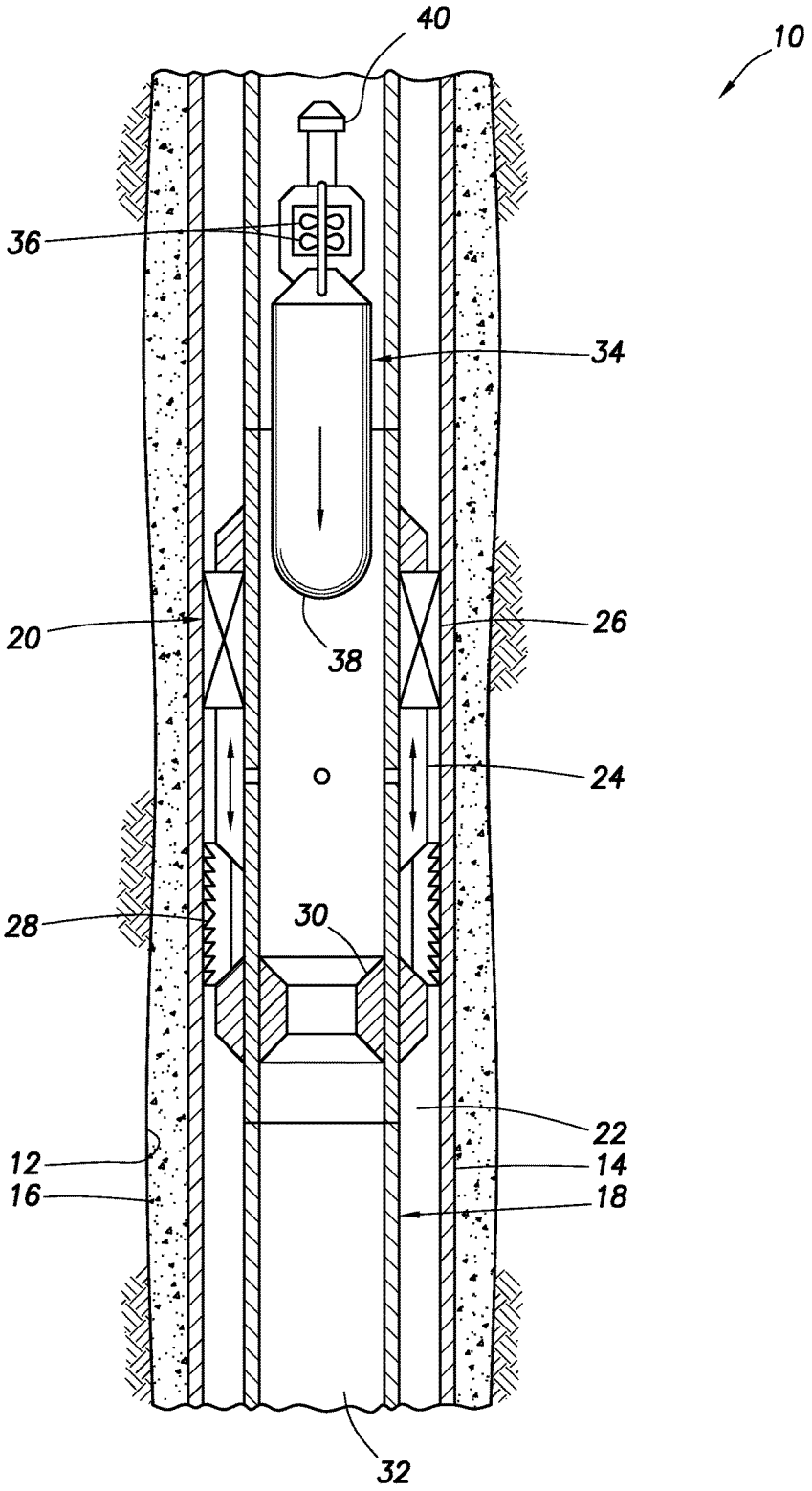
FIG. 1 is a representative partially cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is lined with casing 14 and cement 16. The wellbore 12 in this example is generally vertical, but in other examples, the wellbore could be generally horizontal or inclined from vertical. In addition, it is not necessary for any particular portion of the wellbore 12 to be lined with casing 14 or cement 16.

A tubular string 18 (such as, a gravel packing, stimulation, completion or production tubing string, a drill string, etc.) is positioned in the casing 14. The tubular string 18 includes a hydraulically operated packer 20 for sealing off an annulus 22 formed between the tubular string and the casing 14.

The packer 20 is one example of a well tool that can be operated using the principles of this disclosure. Other examples include (but are not limited to) artificial lift equipment, reamers and valves (such as, sliding sleeve valves, etc.). Thus, the scope of this disclosure is not limited to use with any particular type of well tool, or to any particular details of the packer 20.

In the FIG. 1 example, the packer 20 includes a hydraulic actuator 24 for radially outwardly extending a seal element 26 and slips 28. A sealing surface 30 (such as, a seat or seal bore, etc.) is provided in the packer 20 to isolate a section of the tubular string 18 above the sealing surface. In this manner, pressure can be applied to the tubular string 18 upper section (for example, using a pump at a surface of the earth or on a water-based rig) to operate the actuator 24 and thereby set the packer 20.

The packer 20 is set when the actuator 24 outwardly extends the seal element 26 into sealing engagement with the casing 14, and outwardly extends the slips 28 into gripping engagement with the casing. Such hydraulically actuated packers are well known to those skilled in the art, and so further details of the packer 20 are not described herein.

To sealingly engage the sealing surface 30 and thereby seal off an interior passage 32 of the tubular string 18, a deployment apparatus 34 is introduced into the passage. In this example, the apparatus 34 is self-propelled, so that the apparatus does not rely on gravity or flow of fluid through the passage 32 in order to convey the apparatus through the passage (although gravity or fluid flow may also act on the apparatus to assist in displacing it through the passage).

As depicted in FIG. 1, the apparatus 34 includes two propellers 36. The propellers 36 can rotate in opposite directions to propel the apparatus 34 through the passage 32, without causing the apparatus itself to rotate. However, other numbers of propellers 36 (including one) may be used in other examples, and it is not necessary for multiple propellers to rotate in opposite directions.

The apparatus 34 also includes a sealing device 38. In this example, the sealing device 38 is in the form of a spherically-shaped nose on the apparatus 34. The sealing device 38 can sealingly engage the sealing surface 30 to thereby plug the passage 32.

A device 40 known to those skilled in the art as a "fishing neck" is provided on one end of the apparatus 34. The device 40 can be used to retrieve the apparatus 34 from the passage 32, if desired, using an appropriate "fishing tool" (not shown).

Note that the apparatus 34 can be used to convey the sealing device 38 through the passage 32 and into engagement with the sealing surface 30, even if the wellbore 12 is horizontal or inclined upward, and even if no fluid is pumped through the passage. In addition, even in circumstances where gravity and/or fluid flow acts to advance the apparatus 34 toward the sealing surface 30, propulsion provided by the propellers 36 will ensure that the sealing device 38 engages the sealing surface sooner than it would without the propulsion.

As described more fully below, the propulsion provided by the propellers 36 can in some examples be controlled, so that a speed of displacement or propulsive force of the apparatus 34 can also be controlled. For example, it may be desirable to have the apparatus 34 displace at a relatively high speed, until the apparatus approaches the sealing surface 30, at which point the apparatus could displace at a slower speed, in order to avoid damage to the sealing surface 30 or sealing device 38. As another example, it may be desirable to increase the propulsion just before and/or after the sealing device 38 engages the sealing surface 30, in order to ensure sealing engagement, or at least to mitigate any leaks.

Figure 2:
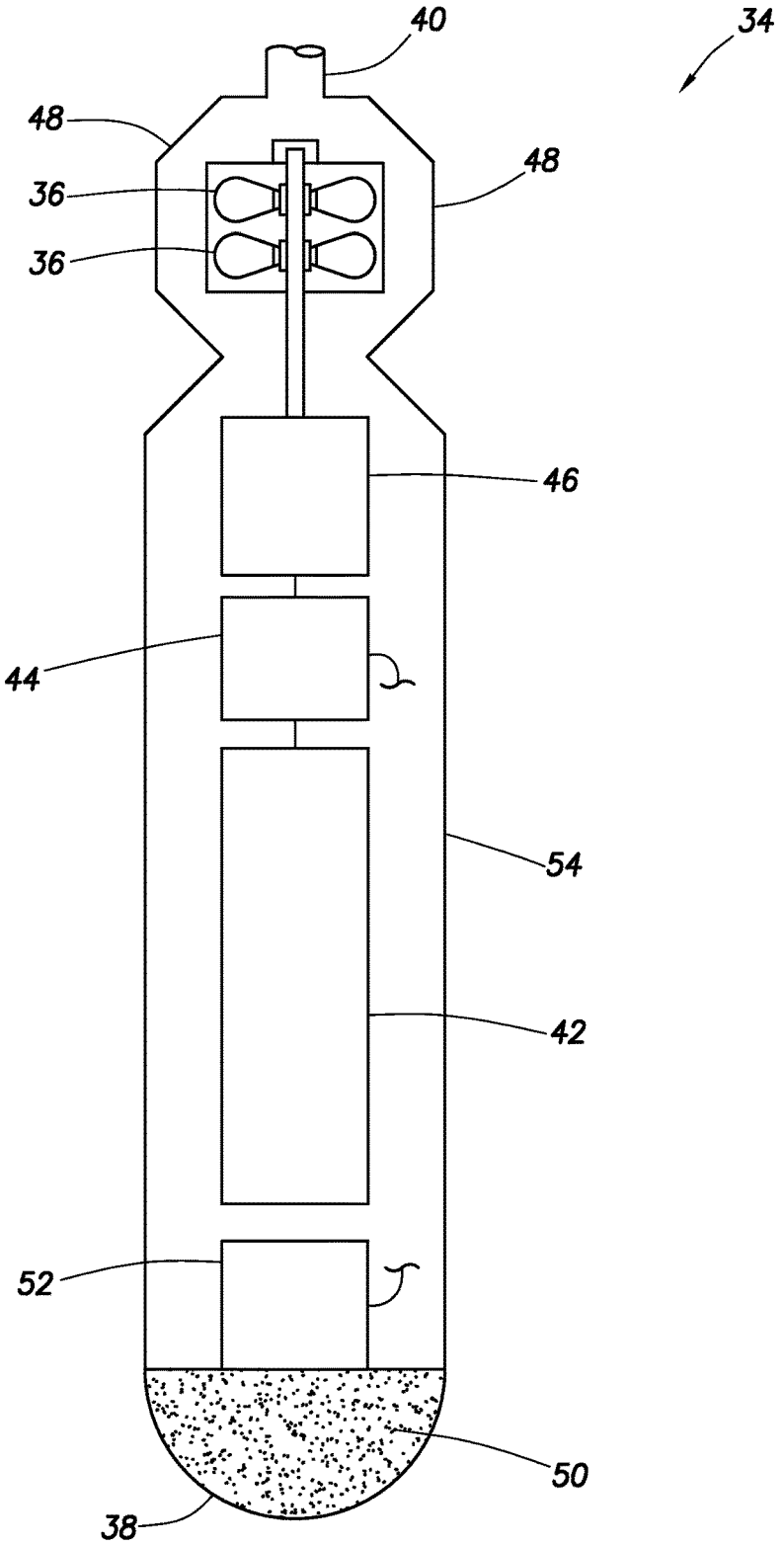
FIG. 2 is a representative enlarged scale cross-sectional view of a deployment apparatus that may be used in the system and method of FIG. 1, and which can embody the principles of this disclosure.

Referring additionally now to FIG. 2, an enlarged scale cross-sectional view of one example of the deployment apparatus 34 is representatively illustrated. The deployment apparatus 34 may be used in the system 10 and method of FIG. 1, or it may be used with other systems and methods.

In the FIG. 2 example, the apparatus 34 includes batteries 42, a controller 44 and a motor 46. The controller 44 can comprise electronic circuitry configured to control application of electrical power from the batteries 42 to the motor 46. Note that any types or numbers of batteries, controller and motor may be used in the apparatus 34, in keeping with the principles of this disclosure.

The controller 44 may include devices (such as, a timer, a temperature sensor, a pressure sensor, a gyroscope, accelerometers, etc.), to provide a corresponding stimulus that prompts the controller to change a rotational speed of the motor 46 and propellers 36. For example, the controller 44 may vary the rotational speed in response to a predetermined time delay, a predetermined temperature, a predetermined pressure, a predetermined depth, etc.

The propellers 36 are protected in the FIG. 2 example by vanes 48. In other examples, centralizers, wheels, rollers, control surfaces or other devices may be used to protect the propellers 36 and/or perform other functions. As described more fully below, control surfaces may be used to change a direction of displacement of the apparatus 34.

The sealing device 38 in the FIG. 2 example can be made of, or at least comprise, a dispersible or degradable material 50. The material 50 may degrade or disperse in response to passage of a predetermined amount of time, exposure to an elevated temperature, exposure to a degrading substance, oxidation, corrosion, hydration or any other stimulus or condition. However, the sealing device 38 may be formed from non-degrading materials instead of, or in addition to, the degradable material 50, if desired, in keeping with the scope of this disclosure.

One purpose for degrading the material 50 can be to permit flow through the passage 32 after the packer 20 has been successfully set (see FIG. 1). Another purpose can be to change a buoyancy of the apparatus 34.

It may be desirable to change a buoyancy of the apparatus 34 in a well, in order to provide for convenient retrieval of the apparatus after it has performed its function, after a predetermined period of time, etc. For example, the apparatus 34 may initially have a negative buoyancy, so that it "sinks" in whatever fluid is present in the well. Then (such as, after the apparatus 34 has performed its function), the buoyancy of the apparatus can be changed to positive, so that the apparatus "floats" upward for retrieval.

If the material 50 is more dense as compared to a remainder of the apparatus 34, then the buoyancy of the apparatus will increase when the material disperses, degrades or is separated from the remainder of the apparatus. Note that it is not necessary for the apparatus 34 to initially have a negative buoyancy. The apparatus 34 could instead initially have a neutral or somewhat positive buoyancy, if desired.

In some examples, the controller 44 could control dispersal, degradation or release of the material 50. For example, the controller 44 could control operation of an actuator 52 that exposes the material 50 to a substance (such as, acid, water, ammonia, etc.) that degrades or disperses the material.

In some examples, the material 50 may not disperse or degrade, but may be released or separated from the remainder of the apparatus 34 by the actuator 52. For example, the actuator 52 could comprise a latching device that unlatches or otherwise detaches the material 50 from the remainder of the apparatus 34 in response to an appropriate signal from the controller 44.

Whether or not a buoyancy of the apparatus 34 increases in the well, retrieval of the apparatus can be accomplished by reversing a rotation of the propellers 36 to thereby propel the apparatus in an opposite direction (e.g., back to surface). The controller 44 may operate the motor 46 to reverse a direction of rotation of the propellers 36, for example, in response to a predetermined time delay, a predetermined temperature, a predetermined pressure, a predetermined depth, a predetermined sequence of events, etc.

The batteries 42, controller 44, motor 46, actuator 52 and/or other components of the apparatus 34 may be enclosed within a pressure resistant outer housing 54. In other examples, the housing 54 may not isolate the batteries 42, controller 44, motor 46, actuator 52 and/or other components from well pressure. Such a configuration may be desirable, for example, to allow the housing 54 to be made thinner for more efficient use of space.

The entire apparatus 34 may be made of a dispersible, dissolvable or otherwise degradable material. In this manner, the apparatus 34 can be degraded, for example, after it has performed its function in the well, after a predetermined period of time, etc. Suitable degradable materials for this purpose are described in International application no. PCT/US13/66124, filed on 22 Oct. 2013, although other degradable materials may be used if desired.

Figure 3:
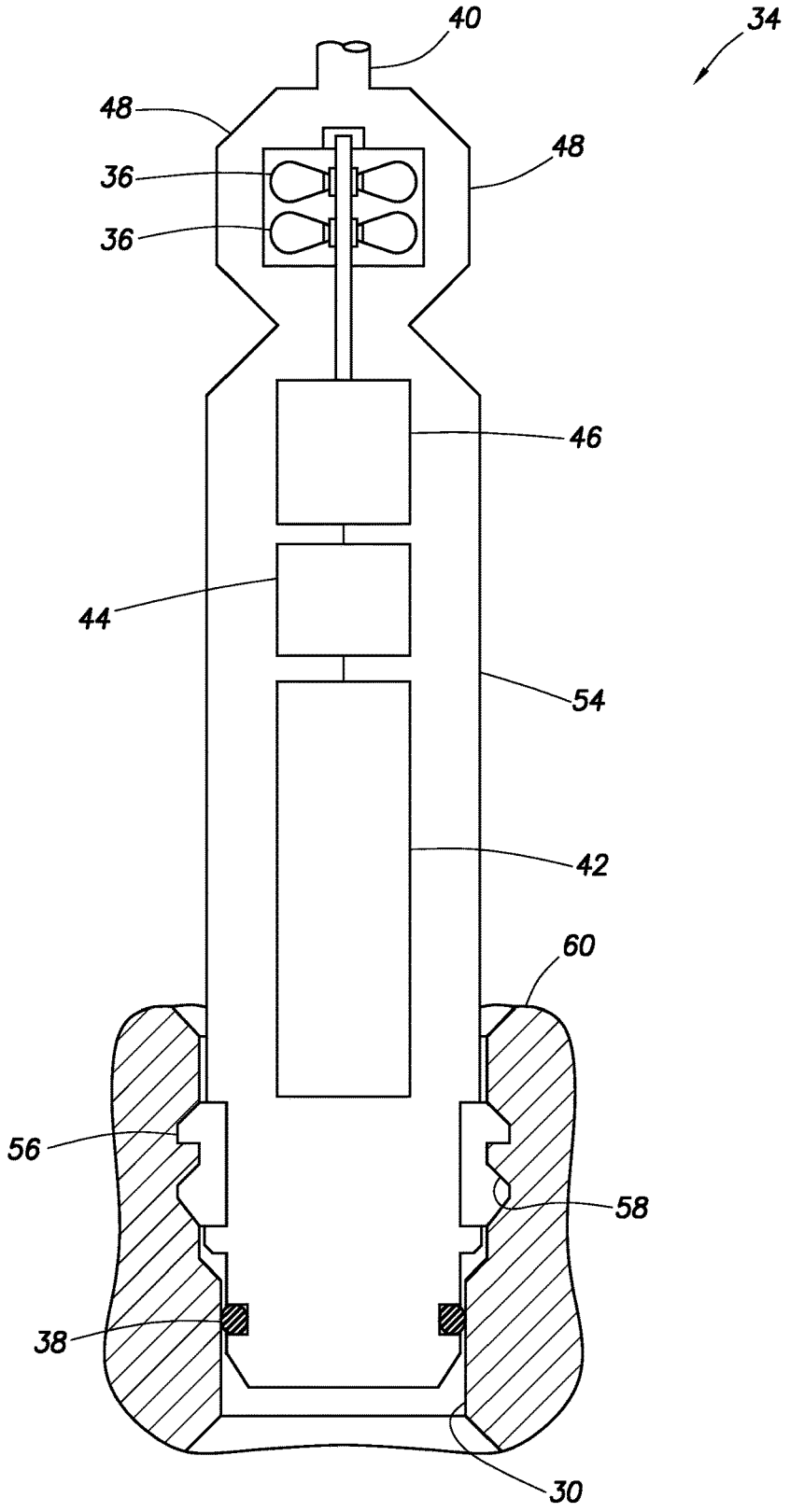
FIG. 3 is a representative cross-sectional view of another example of the deployment apparatus sealingly engaged with a seal surface in a well.

Referring additionally now to FIG. 3, another example of the deployment apparatus 34 is representatively illustrated. In this example, a different type of sealing device 38 is conveyed by the apparatus 34, for sealing engagement with a corresponding different type of sealing surface 30.

The sealing surface 30 in the FIG. 3 example comprises a seal bore, and the sealing device 38 is in the form of a resilient seal (such as, an o-ring, a "quad" seal, or another type of seal). Thus, the scope of this disclosure is not limited to use of any particular type of seal, sealing device or sealing surface.

Another difference in the FIG. 3 example is that an anchoring device 56 (such as, a latch, keys, dogs, slips, fishing tool, etc.) is provided for engagement with an appropriately configured surface or profile 58 in or on a well tool 60 (such as, a packer, a valve, a reamer, artificial lift equipment, etc.). The anchoring device 56 could be self-actuating (for example, using springs or other biasing devices), or in some examples the actuator 52 (see FIG. 2) could be used to actuate the anchoring device.

Note that it is not necessary for both of the sealing device 38 and the anchoring device 56 to be conveyed in the well by the apparatus 34. For example, the anchoring device 56 could be used to operate or retrieve the well tool 60, without the sealing device 38 also being used to sealingly engage the sealing surface 30.

Figure 4:
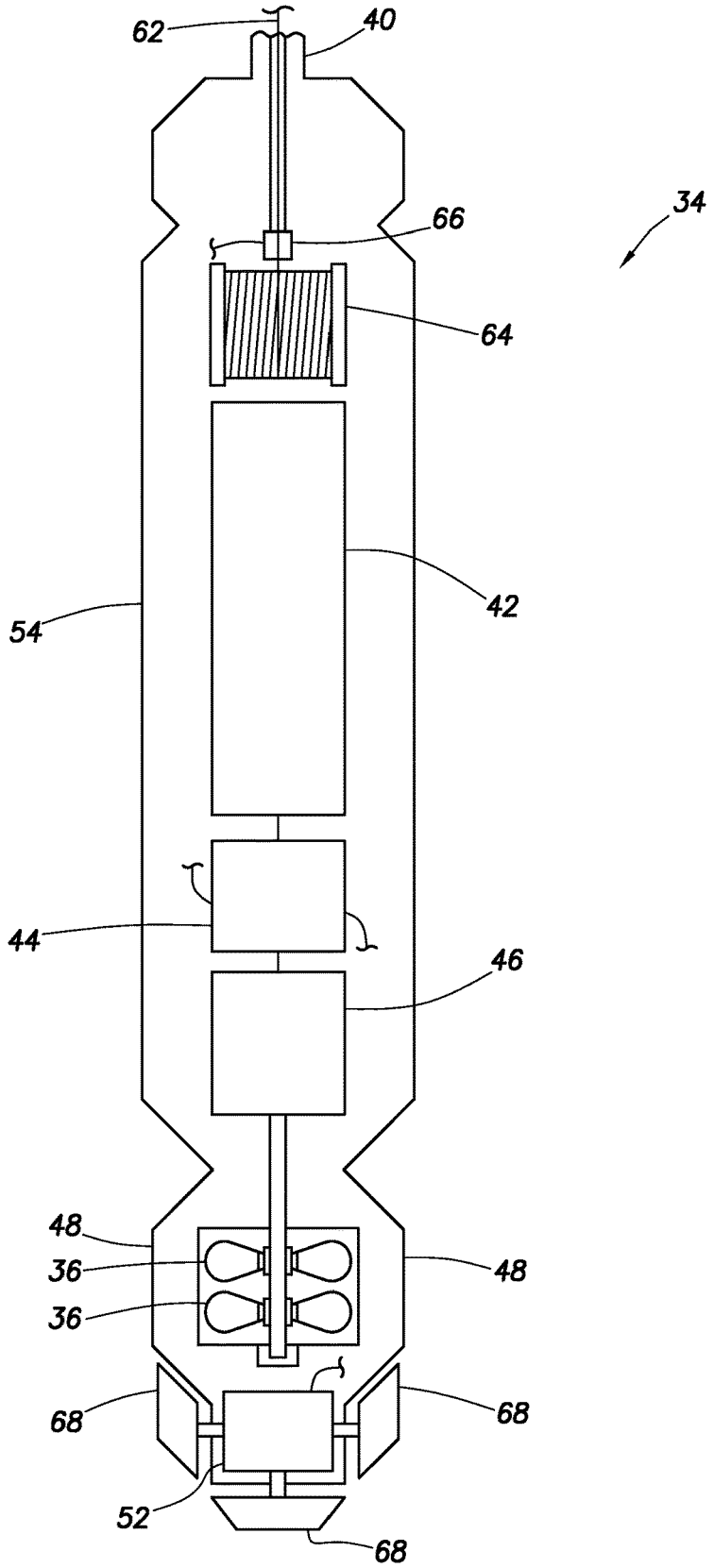
FIG. 4 is a representative cross-sectional view of another example of the deployment apparatus.

Referring additionally now to FIG. 4, another example of the deployment apparatus 34 is representatively illustrated. In this example, the propellers 36 are positioned at an opposite end of the apparatus 34 and the sealing device 38 is not used.

The apparatus 34 of FIG. 4 is instead used to deploy a line 62 (such as, an optical, electric and/or hydraulic line, etc.) in the well. The line 62 is stored on a spool 64 in the apparatus 34. As the apparatus 34 is propelled through the well, the line 62 pays out from the spool 64 and is thereby extended along a wellbore, through a tubular string, etc.

A load cell or other sensor 66 can be used to monitor tension or speed of deployment of the line 62. For example, the sensor 66 can be connected to the controller 44. The controller 44 can regulate a speed of the motor 46, in response to input from the sensor 66, so that tension in the line 62 is maintained within an acceptable range, so that the line pays out from the spool 64 at an acceptable rate, etc.

The actuator 52 in the FIG. 4 example is used to displace control surfaces 68. The control surfaces 68 permit a direction of displacement of the apparatus 34 to be changed in the well. For example, the control surfaces 68 may be used to steer the apparatus 34 into a branch or lateral wellbore (not shown), to steer the apparatus away from an obstruction, to manipulate the apparatus relative to a well tool, etc.

It may be desirable in some circumstances for multiple deployment apparatuses 34 to be used for deploying the line 62, for example, if the line is to be deployed along a substantial length in the well, if friction or other resistance is substantial, etc. If multiple apparatuses 34 are used, the apparatuses may be spaced apart along the line, with the sensor 66 and controller 44 of each maintaining tension in a respective section of the line 62 within an acceptable range.

It may now be fully appreciated that the above disclosure provides significant advancements to the art of deploying objects and substances into wells. In some examples described above, the apparatus 34 is self-propelled and can be used to deploy objects or substances in a well, whether or not such deployment is assisted or impeded by force of gravity, fluid flow, etc.

A well system 10 is provided to the art by the above disclosure. In one example, the system 10 can comprise a deployment apparatus 34 including at least one propeller 36 that propels the deployment apparatus through a wellbore 12.

The deployment apparatus 34 can include a motor 46 that rotates the propeller 36.

The deployment apparatus 34 can include a controller 44 that varies a rotational speed of the propeller 36 in the wellbore 12.

The deployment apparatus 34 may convey a sealing device 38 through the wellbore 12.

A buoyancy of the deployment apparatus 34 may change in the wellbore 12.

The deployment apparatus 34 may deploy a line 62 through the wellbore 12.

The deployment apparatus 34 may sealingly engage a sealing surface 30 in the wellbore.

In another aspect, a deployment apparatus 34 for use in a subterranean well is provided to the art by the above disclosure. In one example, the apparatus 34 can comprise a sealing device 38 that sealingly engages a sealing surface 30 in the well, and at least one propeller 36 that propels the deployment apparatus 34 in the well.

The deployment apparatus 34 may include at least one battery 42, and a motor 46 powered by the battery. The motor 46 rotates the propeller 36.

At least a portion of the apparatus 34 may be degradable in the well.

A buoyancy of the apparatus 34 may decrease in the well.

The deployment apparatus 34 may include a line 62 that withdraws from the apparatus as the apparatus is propelled in the well.

The deployment apparatus 34 may include a controller 44 that changes a rotational speed of the propeller 36 in the well.

The deployment apparatus 34 may include an actuator 52 and at least one control surface 68. A direction of displacement of the apparatus 34 in the well changes in response to displacement of the control surface 68 by the actuator 52.

A deployment method for use with a subterranean well is also described above. In one example, the method can comprise: disposing a deployment apparatus 34 in a wellbore 12 of the well, the deployment apparatus including at least one propeller 36; and the propeller propelling the deployment apparatus in the wellbore.

The method can include a rotational speed of the propeller 36 changing in the wellbore 12.

The propelling step can include conveying a sealing device 38 through the wellbore 12.

The method can include changing a buoyancy of the deployment apparatus 34 in the wellbore 12.

The propelling step can include deploying a line 62 through the wellbore 12.

The method can include the deployment apparatus 34 sealingly engaging a sealing surface 30 in the wellbore 12.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well system, comprising:

a deployment apparatus including two counter-rotating propellers having an axis of rotation and a vane having portions bounding the propellers in front and in back of the propellers' axis of rotation, the propellers being configured to propel the deployment apparatus through a wellbore, wherein the deployment apparatus conveys a sealing device through the wellbore, wherein the propellers are at a first end of the deployment apparatus, and wherein the sealing device is at a second end of the deployment apparatus opposite the propellers, and wherein the sealing device covers the second end of the deployment apparatus.

2. The well system of claim 1, wherein the deployment apparatus further includes a motor that rotates the propellers.

3. The well system of claim 1, wherein the deployment apparatus further includes a controller that varies a rotational speed of the propellers in the wellbore.

4. The well system of claim 1, wherein a buoyancy of the deployment apparatus changes in the wellbore.

5. The well system of claim 1, wherein the deployment apparatus deploys a line through the wellbore.

6. The well system of claim 1, wherein the deployment apparatus sealingly engages a sealing surface in the wellbore.

7. A deployment apparatus for use in a subterranean well, the apparatus comprising:

a sealing device that sealingly engages a sealing surface in the well; and two counter-rotating propellers having an axis of rotation and a vane having portions bounding the propellers in front and in back of the propellers' axis of rotation, the propellers being configured to propel the deployment apparatus in the well, wherein the deployment apparatus conveys the sealing device through the wellbore, wherein the propellers are at a first end of the deployment apparatus, and wherein the sealing device is at a second end of the deployment apparatus opposite the propeller, and wherein the sealing device covers the second end of the deployment apparatus.

8. The deployment apparatus of claim 7, further comprising at least one battery, and a motor powered by the battery, wherein the motor rotates the propellers.

9. The deployment apparatus of claim 7, wherein at least a portion of the sealing device is degradable in the well.

10. The deployment apparatus of claim 7, wherein a buoyancy of the apparatus decreases in the well.

11. The deployment apparatus of claim 7, further comprising a line that withdraws from the apparatus as the apparatus is propelled in the well.

12. The deployment apparatus of claim 7, further comprising a controller that changes a rotational speed of the propellers in the well.

13. The deployment apparatus of claim 7, further comprising an actuator and at least one control surface, and wherein a direction of displacement of the apparatus in the well changes in response to displacement of the control surface by the actuator.

14. A deployment method for use with a subterranean well, the method comprising:

disposing a deployment apparatus in a wellbore of the well, the deployment apparatus including two counter-rotating propellers having an axis of rotation and a vane having portions bounding the propellers in front and in back of the propellers' axis of rotation;

the propellers propelling the deployment apparatus in the wellbore, wherein the propelling further comprises conveying a sealing device through the wellbore, further comprising the sealing device of the deployment apparatus sealingly engaging a sealing surface in the wellbore, wherein the propellers are at a first end of the deployment apparatus, and wherein the sealing device is at a second end of the deployment apparatus opposite the propellers, and wherein the sealing device covers the second end of the deployment apparatus.

15. The method of claim 14, further comprising a rotational speed of the propellers changing in the wellbore.

16. The method of claim 14, further comprising changing a buoyancy of the deployment apparatus in the wellbore.

17. The method of claim 14, wherein the propelling further comprises deploying a line through the wellbore.

* * * * *